US006668610B2

(12) United States Patent
Lagacéet al.

(10) Patent No.: US 6,668,610 B2
(45) Date of Patent: Dec. 30, 2003

(54) METHOD FOR CONTINUOUS TENSION LEVELING OF ALUMINUM STRIP

(75) Inventors: Hélène Lagacé, Bath (CA); Garry Boles, Kingston (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 10/032,650

(22) Filed: Dec. 27, 2001

(65) Prior Publication Data

US 2003/0126903 A1 Jul. 10, 2003

(51) Int. Cl.[7] ..... B21D 1/05; B21B 39/08
(52) U.S. Cl. ..... 72/160; 72/205
(58) Field of Search ..... 72/160, 163, 205

(56) References Cited

U.S. PATENT DOCUMENTS

| | | | | |
|---|---|---|---|---|
| 3,777,532 A | * | 12/1973 | Noe | 72/205 |
| 3,828,599 A | * | 8/1974 | Withrow | 72/163 |
| 3,834,202 A | * | 9/1974 | Kawaguchi et al. | 72/163 |
| 3,867,826 A | | 2/1975 | Noé | 72/205 |
| 4,291,562 A | * | 9/1981 | Orr | 72/205 |
| 4,512,170 A | * | 4/1985 | Hsu | 72/205 |
| 4,587,822 A | | 5/1986 | Bradlee | |
| 5,182,931 A | | 2/1993 | Noé et al. | 72/160 |
| 5,341,664 A | | 8/1994 | Noé et al. | 72/205 |
| 5,535,610 A | | 7/1996 | Noé et al. | 72/205 |

FOREIGN PATENT DOCUMENTS

GB 2 001 558 A 2/1979

OTHER PUBLICATIONS

Noé A., "New Developments in the Leveling of Aluminum Strips", Alumitech '97 Conference, May 20–23, 1997.
Polakowski, H.N., "Restoration of Ductility of Cold–Worked Aluminum, Copper and Low–Carbon Steel by Mechanical Treatment", Proc. ASTM, 52.
Patent Abstracts of Japan, vol. 009, No. 202 (M–405), abstract of JP 60 064728 A (Mitsubishi), Apr. 13, 1985.

* cited by examiner

*Primary Examiner*—Daniel C. Crane
(74) *Attorney, Agent, or Firm*—Cooper & Dunham LLP

(57) ABSTRACT

An aluminum alloy sheet of the AA 6000 series is subjected to a continuous tension leveling procedure. The sheet is passed through a set of pull rollers and a set of brake rollers and subjected to a longitudinal tension between the two roller sets. Also while travelling under longitudinal tension between the two sets of rollers, the sheet is subjected to bending and reverse bending over a series of small rollers at a wrap angle in the range of about 0 to 12°.

7 Claims, 7 Drawing Sheets

METHOD FOR CONTINUOUS TENSION LEVELING OF ALUMINUM STRIP

BACKGROUND OF THE INVENTION

1. Field of the Invention

The present invention relates to a method for continuous tension leveling of thin aluminum strip, particularly 6000 series aluminum alloy strip.

2. Description of the Prior Art

For the leveling and flattening of metal strip, various straightening processes are used, e.g. stretch and tension straightening, tension leveling, tension-bend leveling, etc.

Generally these straightening or leveling processes are carried out continuously by means of tension stretching arrangements using a set of pull rollers and a set of brake rollers and between these sets of rollers stretch-forming forces are applied. During the stretching procedure, the strip is subjected to plastic elongation resulting in a reduction in the strip width and thickness.

It is also known to apply bending forces to the strip under tension, e.g. by bending and reverse bending over a series of small rollers positioned between the pull rollers and the brake rollers. Some prior studies have found that these multiple bendings result in an accumulation of plastic strains causing substantial work hardening. This typically leads to an increase in yield strength and a reduction in formability.

One device for stretching a continuously moving thin metal strip is described in Noé, U.S. Pat. No. 3,867,826. A further system for continuous tension stretching of thin metal strips is described in Noé et al. U.S. Pat. No. 5,182,931. A general review of the leveling of aluminum strip can be found in A. L. Noé, "New Developments in the Leveling of Aluminum Strip", Second International Aluminum Conference and Trade Exposition, Atlanta, Ga., 503–529 (1997).

These prior studies have generally found that softer aluminum alloy strips such as those formed of series AA 1000 and AA 3000 alloys can be run in a pure stretch mode, although harder AA 5000 series alloys are more successfully run in the tension leveling mode with flex rolls.

Yet another study on the action of roller levelers may be found in N. H. Polakowski, "Restoration of Ductility of Cold-Worked Aluminum, Copper and Low-Carbon Steel by Mechanical Treatment", Proceedings, Am. Soc. Testing Mats., pp 1086–1097 (1952). Here tests were conducted on the bending of aluminum rods. This researcher found that cold-worked rod material made from the softer AA 1000 and AA 3000 series aluminum alloys tended to soften when subjected to reverse bending cycles.

Thus, while there appears to be inconsistencies among the studies, in the tension leveling of thin aluminum alloy strips, the prior art has generally concluded that the softer 1000 and 3000 alloys can be run in pure stretch mode while the harder 5000 series alloys require the tension leveling mode.

SUMMARY OF THE INVENTION

According to the present invention, it has surprisingly been discovered that thin aluminum alloy strip or sheet of the AA 6000 series does not behave in the expected manner. The 6000 series aluminum alloy contains both magnesium and silicon as main alloying elements and is generally considered to be harder than the 5000 series alloy which contains only magnesium as the main alloying element. It was therefore expected that 6000 series aluminum alloy sheet would require more reverse bending action during the leveling process than the 5000 series sheet. However, it has been found that the 6000 series aluminum ally sheet or strip achieves the best combination of flatness and formability when the pure stretch mode is used or tension leveling with a low degree of reverse bending.

Thus, the present invention in its broadest aspect relates to a method for continuous tension leveling of AA 6000 series aluminum alloy sheet in which the sheet is passed through a set of pull rollers and a set of brake rollers to subject the sheet to longitudinal tension therebetween. A series of small rollers may also be located between the pull rollers and the brake rollers for subjecting the sheet under longitudinal tension to bending and reverse bending over the rollers. Best results are obtained with the AA 6000 series alloy when the system is operated in a pure stretch mode (0° wrap angle) or at a wrap angle about the small rollers of no more than about 12°.

For tension leveling, the alloy strip typically has a thickness in the range of about 0.1 to 4.0 mm, preferably about 0.8 to 2.1 mm. The strip is subjected to a longitudinal stretch of about 0.4 to 1.0%, preferably 0.8 to 1.0%.

BRIEF DESCRIPTION OF THE DRAWINGS

In the drawings which illustrate this invention:

As seen in FIG. 1, the device for carrying out the invention comprises three main components, namely a drag bridle 10, a tension leveler 11 and a pull bridle 12. The drag bridle 10 comprises essentially brake rollers and the incoming aluminum alloy sheet 13 passes around rollers 14, 15, 16 and 17 from which it enters into the tension leveler 11.

Figure 1:
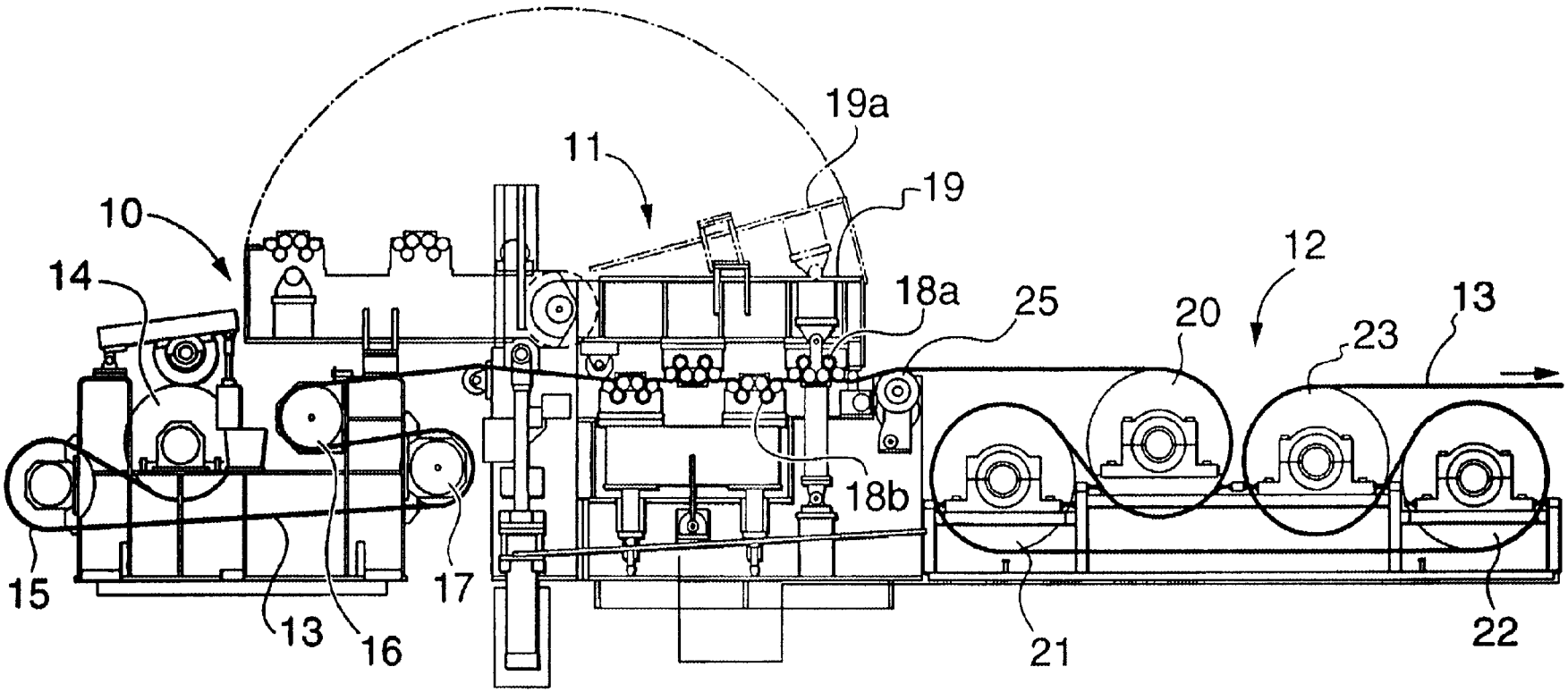
FIG. 1 is an elevation view of a tension leveling device.

The tension leveler 11 includes a pair of upper small roller sets 18*a* and a pair of lower small roller sets 18*b* and the degree of wrap of the sheet 13 about the tension leveler rollers is determined by the location of the upper roller sets 18*a*. It will be seen that these upper roller sets 18*a* are mounted on a pivotal support frame 19 which can be pivoted upwardly into position shown at 19*a*.

The pull bridle 12 comprises a series of pull rollers 20, 21, 22 and 23 and the sheet 13 emerges from the tension leveler over guide roll 25 and travels around these pull rolls in sequence.

Figure 2:
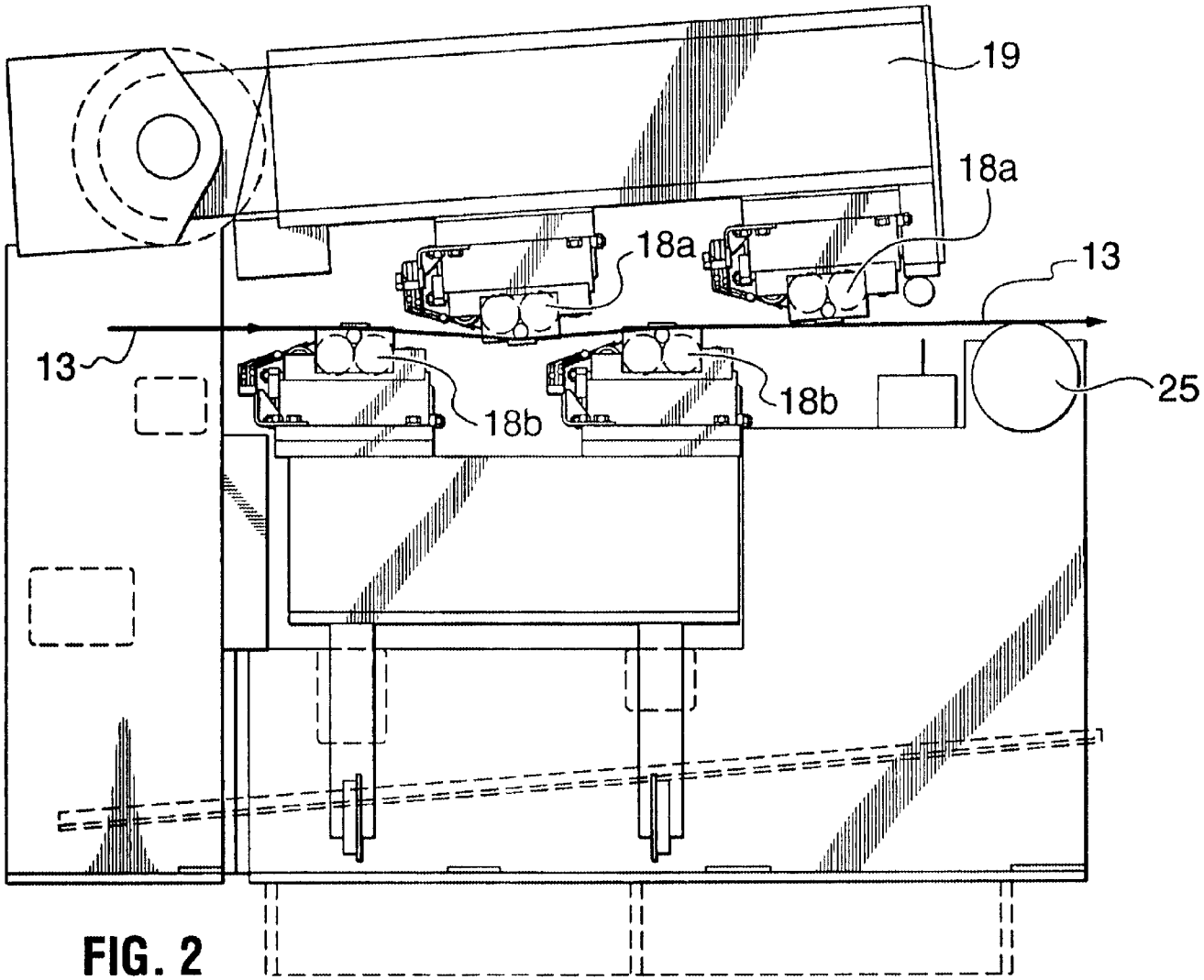
FIG. 2 is an elevation view of the bending rollers at a wrap angle of 11.5°.

FIG. 2 shows the pivotal frame 19 and the upper tension leveler where rollers 18*a* are positioned for a roll wrap angle of about 11.5°.

Figure 3:
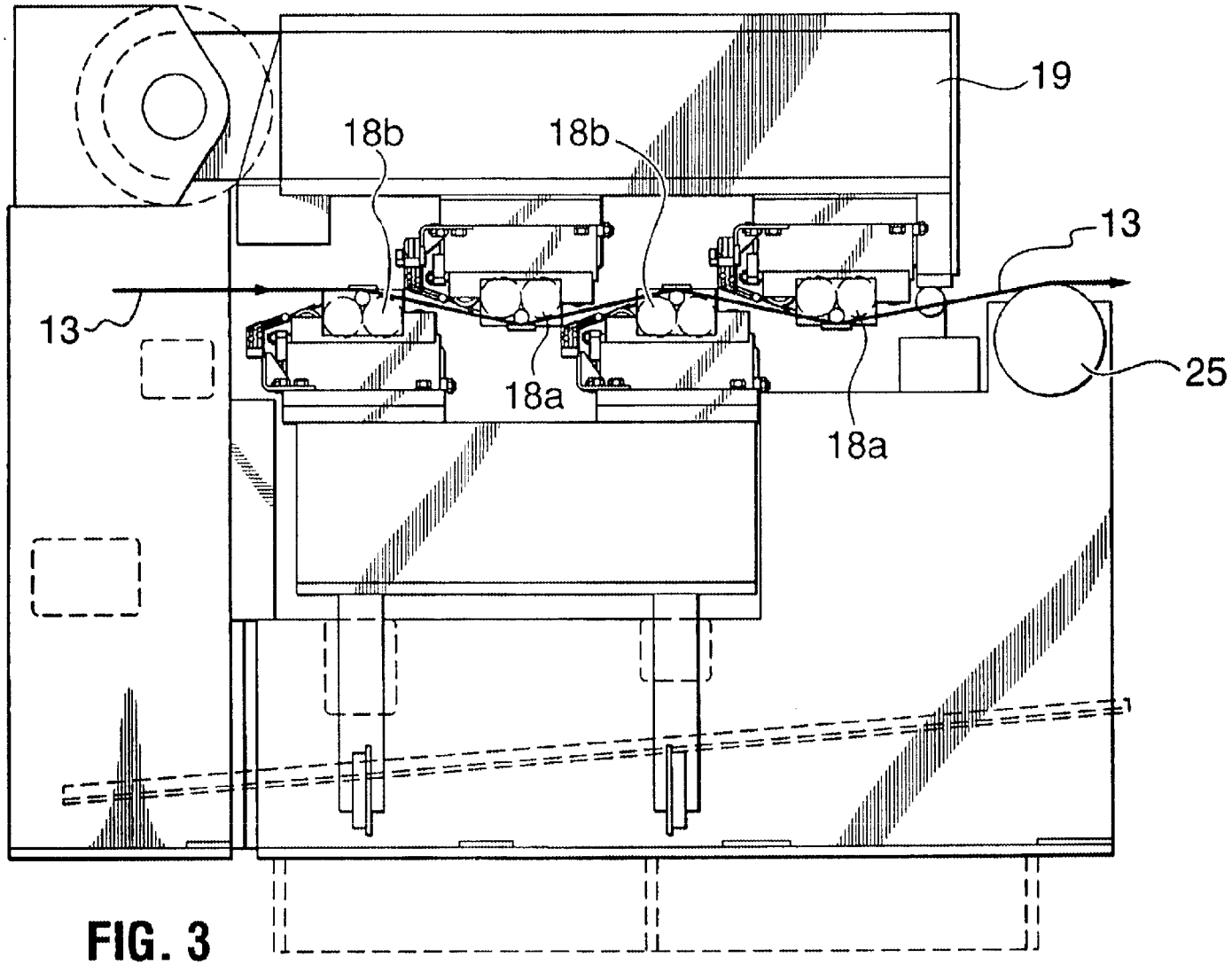
FIG. 3 is an elevation view of the bending rollers at a wrap angle of 23.5°.

FIG. 3 shows the frame 19 and upper rolls 18*a* moved further in a downward direction relative to the lower rolls 18*b* thereby increasing the wrap angle. In FIG. 3 the wrap angle is approximately 23.5°.

Figure 4:
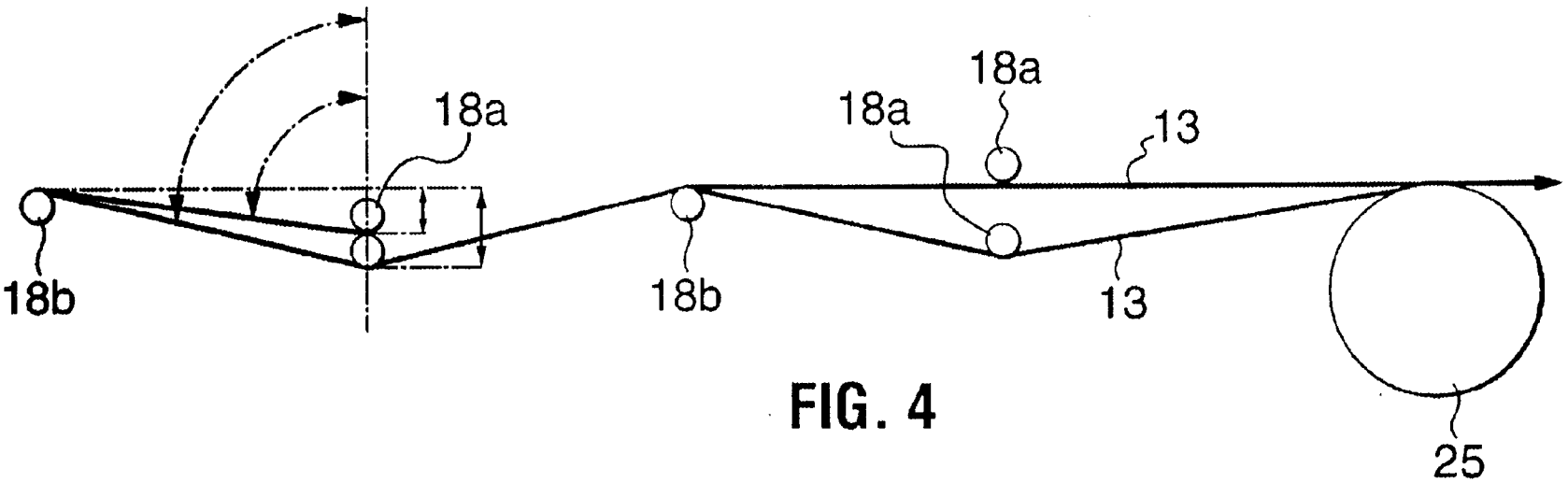
FIG. 4 is a schematic view of the bending rollers.
Figure 5A:
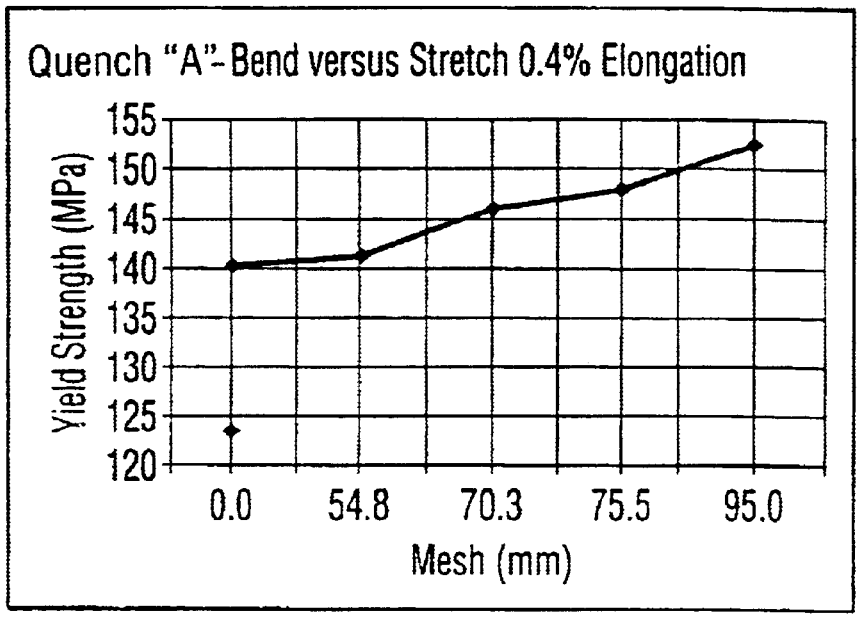
FIGS. 5A and 5B are plots of bend vs stretch for a first quench process.
Figure 5B:
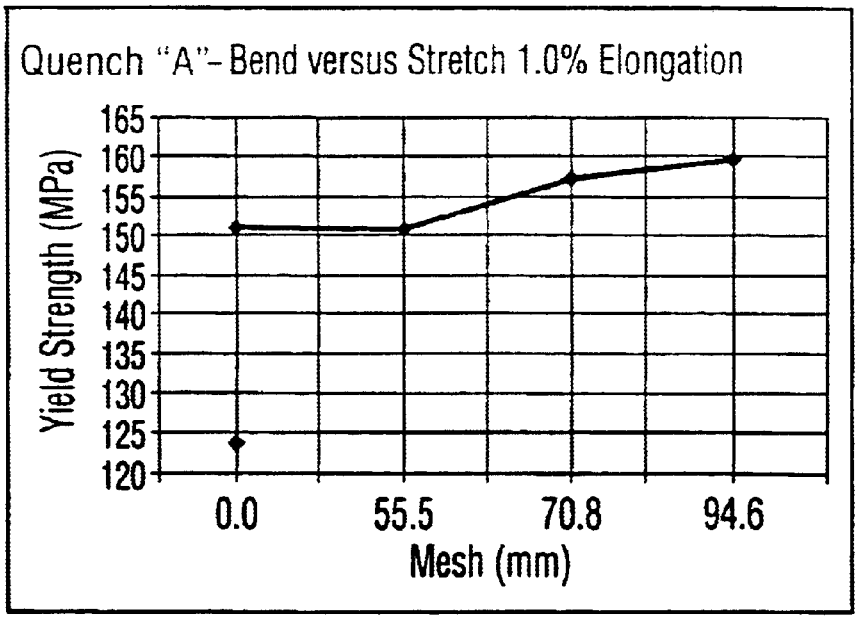
Figure 6A:
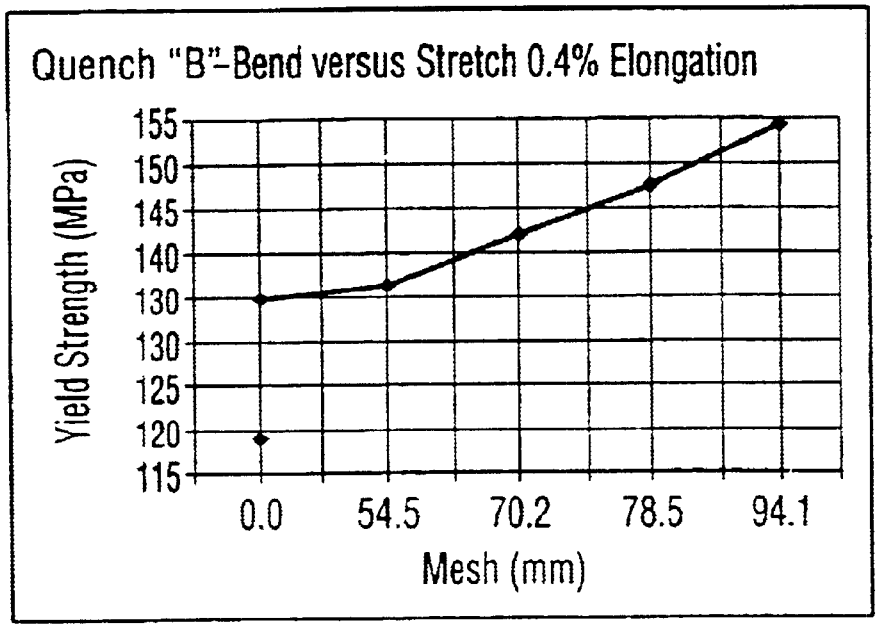
FIGS. 6A and 6B are plots of bend vs stretch for a second quench process.
Figure 6B:
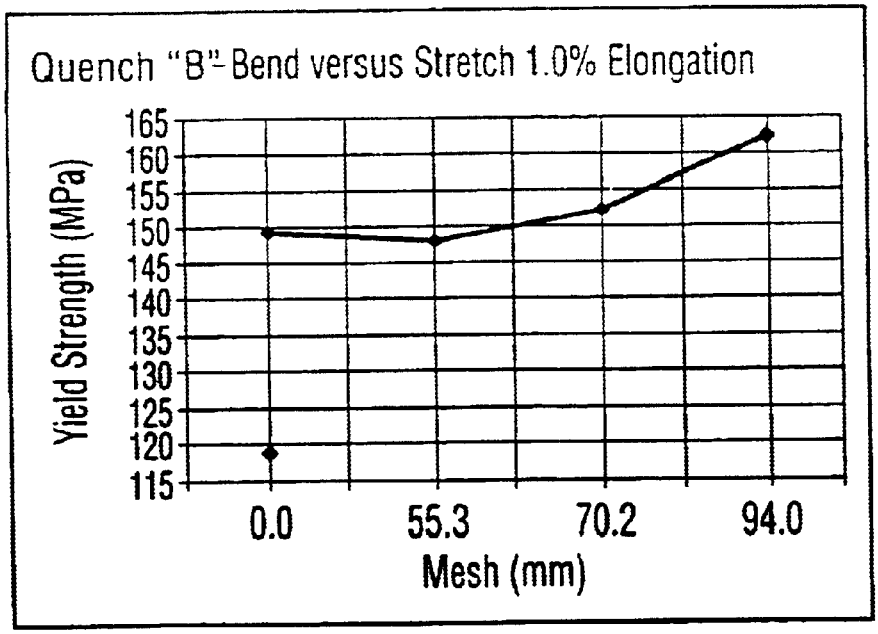
Figure 7A:
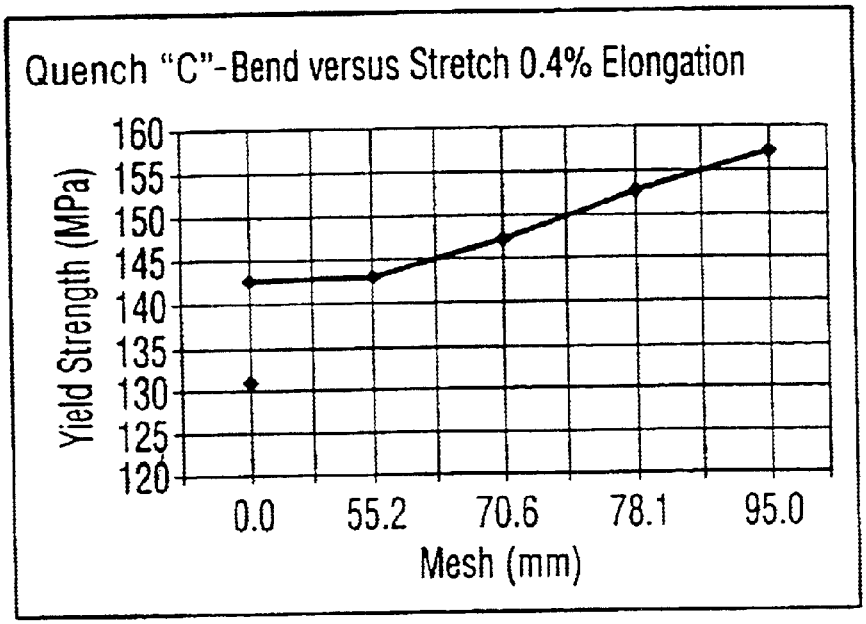
FIGS. 7A and 7B are plots of bend vs stretch for a third quench process.
Figure 7B:
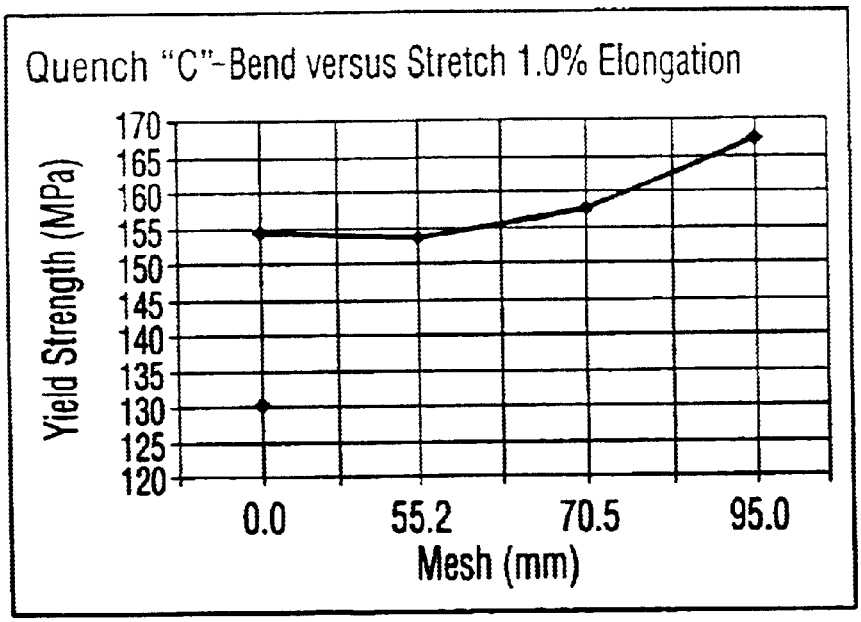

The different wrap angles can also be expressed in terms of "mesh" and this is shown schematically in FIG. 4. Thus, the mesh is the actual vertical distance of adjustment of the upper rolls 18*a* with one location being adjusted downwardly by a distance of 47 mm from the passline and the second location being a downward adjustment by a distance of 95 mm from the passline. The 47 mm mesh is approximately equivalent to a wrap angle of about 11.5° and the 95 mm mesh is approximately equivalent to a wrap angle of about 23.5°. The wrap angle is defined as the sum of the two angles made by the sheet as it is deflected away from the passline on both sides of a roll. The relationship between the angle of the sheet and the mesh is shown in Table 1 below:

TABLE 1

| Angle (°)* | Mesh (mm) |
|---|---|
| 5.75 | 47.00 |
| 8.76 | 70.58 |
| 9.68 | 78.13 |
| 11.75 | 95.00 |

*The wrap angle is double the sheet angle.

FIG. 4 schematic also shows an arrangement with upper rollers 18*a* out of contact with sheet 13, this representing a pure stretch mode or 0° wrap angle.

EXAMPLE 1

A series of tests were conducted on AA 6111 aluminum alloy sheet. The alloy has the typical composition:

| | Cu | Fe | Mg | Mn | Si | Ti | Zn | Cr |
|---|---|---|---|---|---|---|---|---|
| min | 0.5 | | 0.50 | 0.15 | 0.70 | | | |
| max | 0.9 | 0.40 | 1.00 | 0.45 | 1.1 | 0.1 | 0.15 | 0.1 |

and the balance aluminum and incidental impurities. The alloy was cast and rolled to a sheet thickness of about 0.93 mm. The sheet was solution heat treated at about 550° C. and thereafter cooled under three different cooling procedures, designated as quench "A", quench "B" and quench "C".

The tension leveler used for the tests contained bending rolls having diameters of 1.75 inches with a horizontal distance center to center spacing of the roll groups of 18 inches. Tensions were applied to the aluminum alloy sheet to provide high and low stretch values of 1.0% and 0.4% and the bending rolls were positioned to provide wrap angles of about 11.5° and 23.5°.

The results obtained are shown in FIGS. 5A, 5B, 6A, 6B, 7A and 7B. A quite similar pattern was observed with three different methods of quench for the aluminum alloy sheet. The general pattern observed is that with the higher degree of elongation of 1%, there was either no change in yield strength or a slight decrease in yield strength for bending roll wrap angles of up to about 12°. At wrap angles beyond about 12° there was a significant increase in yield strength.

At a lower degree of elongation of 0.4%, there was a consistent rise in yield strength with increasing degrees of wrap angle on the bending rolls.

This shows that for the AA 6000 series aluminum alloy formability responds to the degree of stretch rather than the bending action and that the best results were obtained when the bending action is at a wrap angle of no more than about 12°.

What is claimed is:

1. A method for continuous tension leveling of AA 6000 series aluminum alloy strip comprising the steps of (a) providing AA series aluminum alloy strip, (b) passing the strip through a set of pull rollers and a set of brake rollers and subjecting the strip to a longitudinal tension between the two sets of rollers and (c) while the strip is under longitudinal tension between the pull rollers and the brake rollers passing the strip between a series of small rollers positioned above and below the strip while subjecting the strip to bending and reverse bending over the rollers at a wrap angle of no more than about 12°.

2. A method according to claim 1 wherein the strip is subjected to a longitudinal stretch of about 0.4 to 1.0%.

3. A method according to claim 2 wherein the strip has a thickness of about 0.1 to 4.0 mm.

4. A method according to claim 3 wherein the wrap angle is in the range of 0 to 12°.

5. A method according to claim 3 wherein the wrap angle is 0°.

6. A method according to claim 2 wherein the stretch is about 0.8 to 1.0%.

7. A method according to claim 6 wherein the strip has a thickness of about 0.8 to 2.1 mm.

* * * * *